US006541723B1

(12) United States Patent
Rao et al.

(10) Patent No.: US 6,541,723 B1
(45) Date of Patent: Apr. 1, 2003

(54) COVER FOR A ROTARY SWITCH

(75) Inventors: Chepur P. Rao, North Kingstown, RI (US); Peter Cheung, Kowloon (HK)

(73) Assignee: Tower Manufacturing Corporation, Providence, RI (US)

( * ) Notice: Subject to any disclaimer, the term of this patent is extended or adjusted under 35 U.S.C. 154(b) by 0 days.

(21) Appl. No.: 09/940,184

(22) Filed: Aug. 27, 2001

(51) Int. Cl.[7] ..... H01H 3/08
(52) U.S. Cl. ..... 200/336; 200/284
(58) Field of Search ..... 200/335, 284, 200/571, 570, 564

(56) References Cited

U.S. PATENT DOCUMENTS

| | | | | | |
|---|---|---|---|---|---|
| 2,695,933 | A | * | 11/1954 | Daily et al. | 200/16 B |
| 2,813,158 | A | | 11/1957 | Hutt | |
| 3,339,050 | A | | 8/1967 | Mitchell | |
| 3,748,419 | A | * | 7/1973 | Torrey et al. | 200/284 |
| 4,080,522 | A | | 3/1978 | Schimmels | |
| 4,138,184 | A | | 2/1979 | Knopp | |
| 4,166,200 | A | | 8/1979 | Reichen et al. | |
| 4,495,387 | A | | 1/1985 | Thrush | |
| 4,754,104 | A | | 6/1988 | Maltais et al. | |
| 5,072,078 | A | | 12/1991 | Rao et al. | |
| 5,728,982 | A | * | 3/1998 | Rao et al. | 200/11 G |
| 5,750,947 | A | | 5/1998 | Rao et al. | |
| 5,810,161 | A | | 9/1998 | Carroll, Jr. | |
| 5,967,304 | A | * | 10/1999 | MacKay et al. | 200/11 R |
| 6,130,389 | A | | 10/2000 | Rao | |
| 6,265,681 | B1 | * | 7/2001 | Aromin | 200/570 |

* cited by examiner

*Primary Examiner*—Elvin Enad
*Assistant Examiner*—Lisa N Klaus
(74) *Attorney, Agent, or Firm*—Kriegsman & Kriegsman

(57) ABSTRACT

A rotary switch for an electrical appliance includes a housing adapted to receive a plurality of conductive wires, a plurality of conductive terminals fixedly mounted onto the housing, an actuation shaft rotatably mounted onto the housing, and a movable contact mounted onto the actuation shaft for selectively connecting two of the conductive terminals. The housing includes a base and a cover mounted onto the base. The cover includes a top surface, a bottom surface and a plurality of inwardly tapered guide walls. Each guide wall is shaped to define a slot into which an associated conductive wire can be securely retained in electrical isolation from the remainder of conductive wires. Each guide wall has a funnel-type configuration and includes a closed end and an open end, the slot being narrower at the closed end than at the open end.

17 Claims, 3 Drawing Sheets

COVER FOR A ROTARY SWITCH

BACKGROUND OF THE INVENTION

The present invention relates generally to- electric switches and more particularly to rotary electric switches.

Electric switches are well known and widely used in the art.

Rotary electric switches, also commonly referred to simply as rotary switches in the art, are one well known type of electric switch. Rotary switches are primarily utilized in small appliances, such as electric fans, to regulate the application of power to the appliance through the rotation of an actuation shaft.

Rotary switches regulate the application of power to the appliance by selectively connecting various conductive leads for the appliance. Specifically, the motor of the appliance typically includes four output leads, or wires, which define the off, low, medium and high motor speeds. In addition, the power cord provides an input lead for the switch. Accordingly, the four output leads and the single input lead are electrically connected to the rotary switch. Manual rotation of the actuation shaft through a knob or other similar device selectively connects the input lead with each of the output leads so as to provide the appliance with its off, low, medium and high fan power settings.

In U.S. Pat. No. 5,072,078 to C.P. Rao et al., there is disclosed a rotary switch for small appliances, such as electric fans, comprising a base assembly and a cover assembly. The base assembly includes low, medium and high output terminals and a splice terminal in side-by-side relation along one edge thereof. The low, medium, high and splice terminals wedgingly receive the bared ends of a ribbon cable, or alternatively the bared ends of separate leads, with the input terminal and the opposite edge of the splice terminal being located at the opposite edge of the base. The cover assembly carries a rotor having contacts connected thereto whereby the rotor may be rotated so as to effect an electrical connection between either the low, medium or high output terminal and the input terminal.

The particular construction of the rotary switch disclosed in U.S. Pat. No. 5,072,078 to C.P. Rao et al. provides a number of important advantages over other types of rotary switches which are well known in the art.

As a first advantage, the rotary switch disclosed in U.S. Pat. No. 5,072,078 to C.P. Rao et al. is constructed to receive the bared ends of the four output leads in a closely spaced, side-by-side relationship along one side of the wall of the base of the rotary switch. As a consequence, the four output leads can be packaged together as a single ribbon cable. As can be appreciated, the packaging the four output leads into a single ribbon cable significantly simplifies the process for inserting the output leads into the rotary switch, thereby minimizing assembly time, which is highly desirable.

As a second advantage, the rotary switch disclosed in U.S. Pat. No. 5,072,078 to C.P. Rao et al. is constructed to wedgingly receive the bared ends of the various wires, this type of connection being commonly referred to as a "push-in" connection in the art. Specifically, each of the output terminals comprise flat contact portions which are secured onto the bottom wall of the base assembly and upwardly-bent end portions which are disposed to enclose wire receiving apertures formed in the switch. Each of the output terminals is constructed of a resilient, electrically conductive material, such as beryllium copper, which enables the upstanding end portion of each terminal to flex inwardly when an electrical wire is pressed thereagainst. As a result of such inward flexion, each terminal is capable of wedgingly engaging an associated wire as the wire is inserted into the switch. It should be noted that the upstanding end portion of each terminal is often provided with a V-shaped groove which is shaped to receive a wire. Upon insertion of the wire into the switch, the V-shaped groove engages, or digs into, opposing sides of the wire. As can be appreciated, utilization of push-in connections of the type described above significantly simplifies the process for installing wires into the switch, which is highly desirable. Furthermore, the utilization of push-in connections of the type described above which include a V-shaped groove allow each terminal to engage an associated wire in two locations, thereby improving the quality of the contact between the terminal and the wire and significantly increasing the retentive force of the wire within the switch, which is highly desirable.

As a third advantage, the rotary switch disclosed in U.S. Pat. No. 5,072,078 to C.P. Rao et al. is constructed to include a plurality of partition walls on the inner surface of the cover plate. The plurality of partition walls are shaped to define relatively large, enclosed spaces which are adapted to receive the bared lead ends of the output wires. As can be appreciated, the partition walls serve to insure electrical isolation of the bared lead ends of the output wires, which is highly desirable.

Although well known and widely used in the art, the rotary switch disclosed in U.S. Pat. No. 5,072,078 to C.P. Rao et al. suffers from a notable drawback.

Specifically, it has been found that, during the assembly of the switch and the subsequent installation of the switch into an appliance, the switch is often subjected to a considerable amount of twisting and bending which, in turn, causes a considerable amount of twisting and bending of the wires inserted into the switch. The considerable amount of twisting and bending of the wires inserted into the switch creates a leverage action, or crowbar effect, which causes the wires to inwardly bend the end portions of the terminals. As a result, the inward bending of the end portions releases the locking forces of each terminal on its associated wire, thereby enabling the wires to be easily backed out and removed from the switch, which is highly undesirable.

SUMMARY OF THE INVENTION

It is an object of the present invention to provide a novel rotary switch.

It is another object of the present invention to provide a novel rotary switch which is adapted to receive a plurality of conductive leads.

It is yet another object of the present invention to provide a rotary switch as described above which is adapted to receive the plurality of leads in a closely disposed, side-by-side relationship.

It is still another object of the present invention to provide a rotary switch as described above which is adapted to electrically isolate the conductive leads therewithin.

It is yet still another object of the present invention to provide a rotary switch as described above which is adapted to securely retain each of the conductive leads therewithin.

It is another object of the present invention to provide a rotary switch as described above which is adapted to properly orientate the conductive leads as the conductive leads are guided therewithin.

It is yet another object of the present invention to provide a rotary switch as described above which is adapted to limit the movement of the conductive leads once inserted therewithin.

It is still another object of the present invention to provide a rotary switch as described above which is adapted to retain each of the conductive leads in proper electrical connection once inserted therewithin.

Accordingly, as one feature of the present invention, there is provided a rotary switch adapted to receive a plurality conductive wires, said rotary switch comprising a housing adapted to receive the plurality of conductive wires, said housing comprising a first inwardly tapered guide wall, the first inwardly tapered guide wall being shaped to define a slot into which a corresponding conductive wire can be disposed, a plurality of conductive terminals fixedly mounted onto said housing, each conductive terminal being adapted to electrically connect with an associated conductive wire, an actuation shaft rotatably mounted onto said housing, and a movable contact mounted onto said actuation shaft, wherein said movable contact selectively connects selected conductive terminals.

As another feature of the present invention, there is provided a housing for a rotary switch adapted to receive a plurality conductive wires, said housing comprising a base, and a cover mounted onto said base, said cover comprising a top surface, a bottom surface and at least one inwardly tapered guide wall formed on the bottom surface, the at least one inwardly tapered guide wall being shaped to define a slot into which a corresponding conductive wire can be disposed.

As another feature of the present invention, there is provided a cover for a rotary switch adapted to receive a plurality conductive wires, said cover comprising a top surface, a bottom surface, and at least one inwardly tapered guide wall formed on the bottom surface, the at least one inwardly tapered guide wall being shaped to define a slot into which a corresponding conductive wire can be disposed.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration an embodiment for practicing the invention. The embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate an embodiment of the invention and, together with the description, serve to explain the principles of the invention. In the drawings wherein like reference numerals represent like parts.

DETAILED DESCRIPTION OF A PREFERRED EMBODIMENT

Rotary switch

Figure 1:
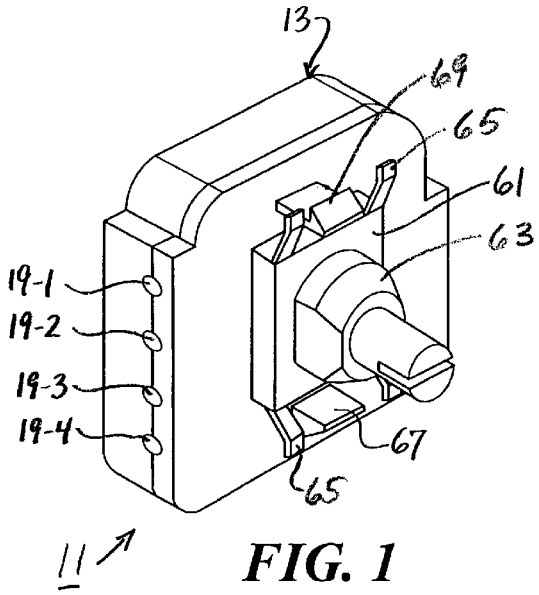
FIG. 1 is a left side, perspective view of a rotary switch constructed according to the teachings of the present invention, the rotary switch being shown in its assembled form.
Figure 2:
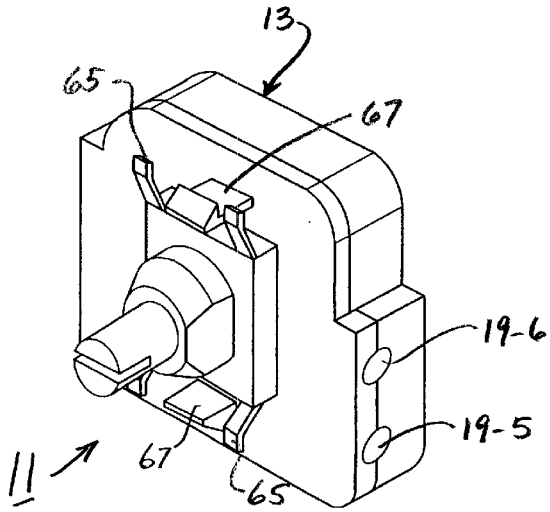
FIG. 2 is a right side, perspective view of the rotary switch shown in FIG. 1, the rotary switch being shown in its assembled form.
Figure 3:
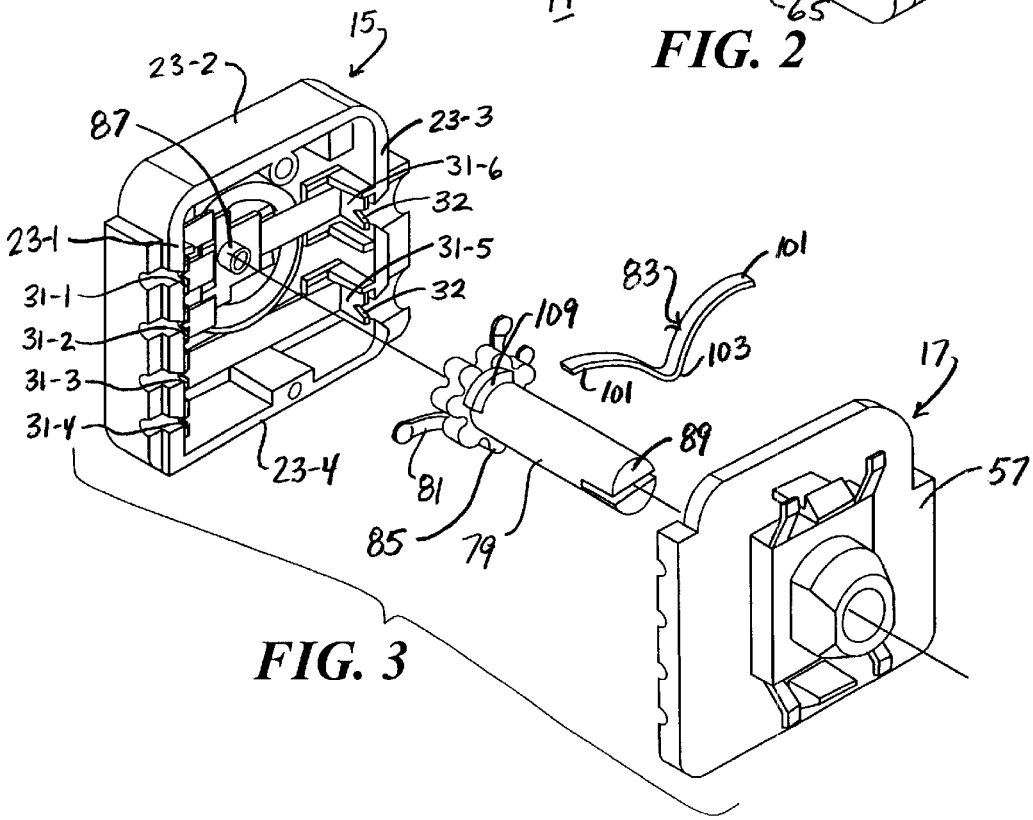
FIG. 3 is an exploded perspective view of the rotary switch shown in FIG. 1.

Referring now to FIGS. 1–3, there is shown a rotary switch constructed according to the teachings of the present invention, the rotary switch being identified generally by reference numeral 11.

As can be appreciated, rotary switch 11 can be used to control the power settings of an electric appliance, such as an electric fan. In this capacity, a plurality of conductive wires, or leads, from the electric appliance and the power source are electrically connected to rotary switch 11 to allow for the various appliance power states, such as off and on, and the various motor speeds, such as low, medium and high motor speeds, as will be described further in detail below.

Rotary switch 11 comprises a housing 13 which is preferably constructed of molded plastic so as to be electrically non-conductive. Housing 13 is of rectangular configuration and comprises a base 15 and a cover 17 which are secured together by any suitable means, such as ultrasonic welding.

It should be noted that four apertures 19-1 through 194 are formed along one side of housing 13 in side-by-side relation. In addition, it should be noted that two apertures 19-5 and 19-6 are formed along the opposite side of housing 15 in side-by-side relation.

Base of Housing

Figure 4:
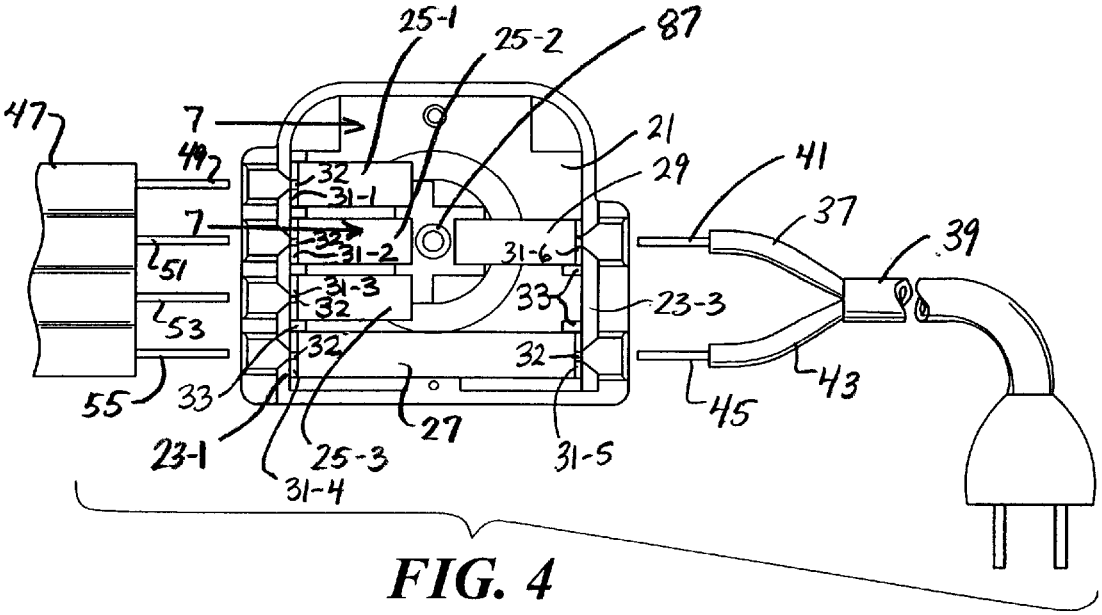
FIG. 4 is a plan view of the base shown in FIG. 1, the base being shown with the conductive terminals mounted thereon, the base also being shown with a power cord and a ribbon cable in alignment for insertion therein.

Referring now to FIGS. 3–4, base 15 comprises a bottom wall 21 and four sidewalls 23-1 through 234 which extend up orthogonally from the outer periphery of bottom wall 21.

Fixedly Mounted Conductive Terminals

A plurality of spaced apart output terminals 25-1, 25-2 and 25-3 are fixedly secured to the bottom wall 21 of base 15 in a side-by-side relation and terminate, at one end, along sidewall 23-1 of base 15, as shown in FIG. 4. In addition, a splice terminal 27 is fixedly secured to bottom wall 21 of base 15 in a side-by-side relation next to output terminal 25-3. It should be noted that splice terminal 27 extends across the entire length of base 15, as shown most clearly in FIG. 4, splice terminal 27 terminating, at one end, along sidewall 23-1 of base 15 and terminating, at the opposite end, along sidewall 23-3 of base 15. Furthermore, an input terminal 29 is fixedly secured to bottom wall 21 of base 15 and terminates, at one end, along sidewall 23-3 of base 15.

Each of the aforesaid terminals comprise a flat contact portion that is fixedly secured to bottom wall 21. In addition, each of the aforesaid terminals comprise an upwardly-bent end portion which is disposed to selectively cover an associated aperture 19 in housing 13. Specifically, output -terminal 25-1 includes an upwardly-bent end portion 31-1 which covers aperture 19-1. Output terminal 25-2 includes an upwardly-bent end portion 31-2 which covers aperture 19-2. Output terminal 25-3 includes an upwardly-bent end portion 31-3 which covers aperture 19-3. Splice terminal 27 includes a first upwardly-bent end portion 31-4 which covers aperture 19-4 and a second upwardly-bent end portion 31-5 which covers aperture 19-5. Input terminal 29 includes an upwardly-bent end portion 31-6 which covers aperture 19-6.

It should be noted that terminals 25, 27 and 29 are all constructed of a resilient, electrically conductive material, such as beryllium copper, whereby upwardly-bent end portions 31 will flex inwardly when an electrical wire is pressed thereagainst. As a result of such inward flexing, the free end of the electrical wire, from which insulation has been stripped, will enter into switch housing 13 in wedging engagement with its associated upwardly-bent end portion 31 so as to effect good electrical contact therewith. This type of connection which is old and well known in the art is commonly referred to simply as a "push-in" wire connection.

It should also be noted that upwardly-bent end portion 31 of each of terminals 25, 27 and 29 is shaped to include a V-shaped groove, or notch, 32 which is sized and shaped to receive a conductive wire. Upon insertion of a conductive wire within switch 11, V-shaped groove 32 in each upwardly-bent end portion 31 is adapted to engage, or dig into, opposing sides of the wire. As a result, V-shaped groove 32 enables each upwardly-bent end portion 31 to engage an associated electrical wire in two locations, thereby improving the quality of the contact between end portion 31 and its associated wire and significantly increasing the retentive force of the wire within switch 11, which is highly desirable.

Figure 6:
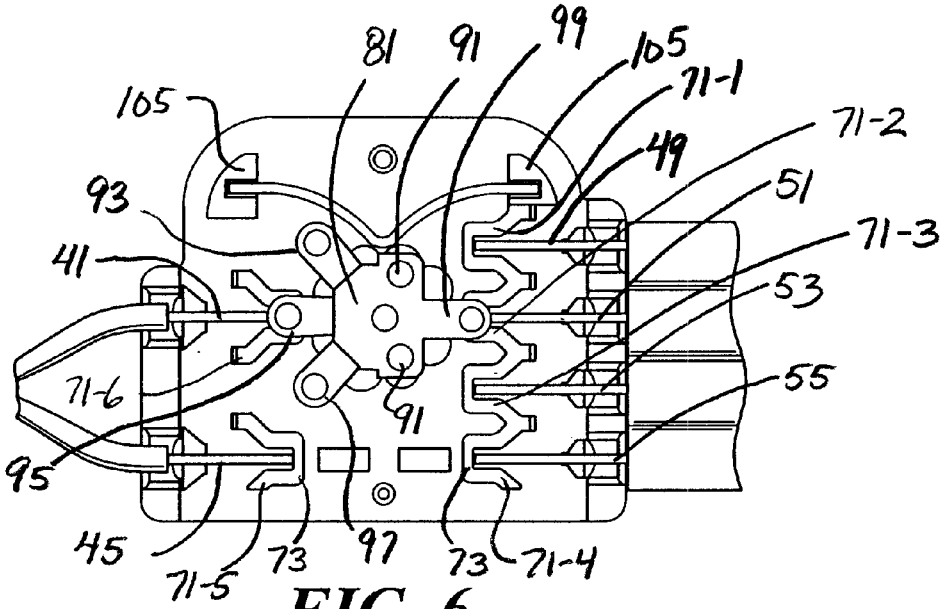
FIG. 6 is a plan view of the inner surface of the cover shown in FIG. 1, the cover being shown with the detent spring and actuation shaft mounted thereon, the actuation shaft being shown with the movable contact mounted thereon, the cover also being shown with the power cord and ribbon cable mounted thereon.
Figure 7:
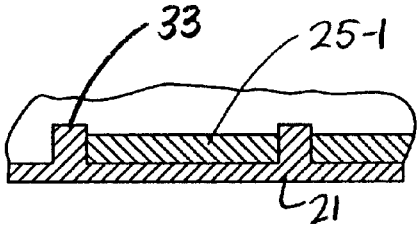
FIG. 7 is a section view of the base and conductive terminals shown in FIG. 4, taken along lines 7—7, before the upper edges of the partitions have been offset to secure the terminals in place.
Figure 8:
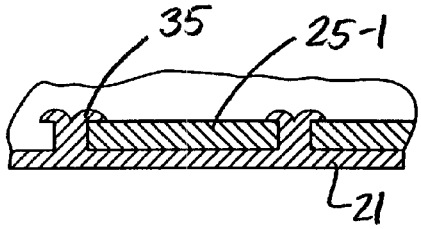
FIG. 8 is a section view of the base and conductive terminals shown in FIG. 4, taken along lines 7—7, after the upper edges of the partitions have been offset.

It should further be noted that it is critical that terminals 25 and 27 be adequately spaced from each other. As such, integral abutments 33 extend upwardly from bottom wall 21 of base 15 and are located between the flat contact portions of adjacent terminals, as illustrated in FIGS. 4 and 6, the upper edges of abutments 33 being offset, as represented by reference numeral 35 in FIG. 8. As can be appreciated, abutments 33 secure terminals 25 and 27 firmly in place against bottom wall 21 and, at the same time, insure the proper spacing between adjacent terminals. Abutments 33 are also located adjacent-opposite side edges of input terminal 29 and splice terminal 27 in order to maintain the entire length of splice terminal 27 and input terminal 29 firmly in place.

Insertion of Wires into Housing

As noted above, the electrical wires for the electric appliance and the power cord can be push-mounted into housing 15. Specifically, with cover 17 mounted onto base 15, an input lead 37 of a power cord 39 having an end 41 bared of insulation, is adapted to be forced through aperture 19-6 and into electrical connection with input terminal 29. In addition, a neutral lead 43 of power cord 39 having an end 45 bared of insulation is adapted to be pressed through aperture 19-5 and into electrical connection with splice terminal 27. Furthermore, ribbon cable 47, which is connected to the motor of the electric appliance, has a bared end 49 which is adapted to be pressed through aperture 19-1 and into electrical connection with output terminal 25-1, a bared end 51 which is adapted to be pressed through aperture 19-1 and into electrical connection with output terminal 25-2, a bared end 53 which is adapted to be pressed through aperture 19-3 and into electrical connection with output terminal 25-3, and a bared end 55 which is adapted to be pressed through aperture 194 and into electrical connection with splice terminal 27.

It should be noted that the capability of switch 11 to receive ribbon cable 47 is an important feature of the present invention. However, it is to be understood that switch 11 is not limited to receiving ribbon cable 47. Rather, switch 11 could alternatively substitute a plurality of individual and separate leads for ribbon cable 47 without departing from the spirit of the present invention.

It should also be noted that the electrical wires for the electric appliance and the power cord are preferably push-mounted into housing 15 in such a manner so that each wire is positioned directly within the V-shaped groove 32 of its associated upwardly-bent end portion 31. As noted above, V-shaped groove 32 enables each upwardly-bent end portion 31 to engage an associated electrical wire in two locations, thereby improving the quality of the contact between end portion 31 and its associated wire and significantly increasing the retentive force of the wire within switch 11, which is highly desirable.

It should further be noted that bared end 55 of ribbon cable 47 is electrically interconnected to neutral lead 43 by means of splice terminal 27. Accordingly, rotary switching means, hereinafter to be described, can be used to selectively interconnect input power terminal 29 with one of terminals 25-1, 25-2 and 25-3 in order to achieve low, medium and high motor speeds, respectively, for the electrical appliance to which ribbon cable 47 is connected.

Cover of Housing

Cover 17 comprises a top, or outer, surface 57 and a bottom, or inner, surface 59.

As shown most clearly in FIGS. 1–3, a generally square projection 61 is integrally formed onto top surface 57 of cover 17. A hub 63 extends from projection 61. In addition, a plurality of clip fingers 65 and a pair of latches 67, each latch 67 having a latching shoulder 69, extend from projection 61 so that switch 11 may be wall mounted when desired. Specifically, the mounting wall (not shown) would have an opening which is configured to snugly receive projection 61 and latch 67 therethrough whereby the supporting wall would actually be clamped between latching shoulder 69 and clip fingers 65.

Figure 5:
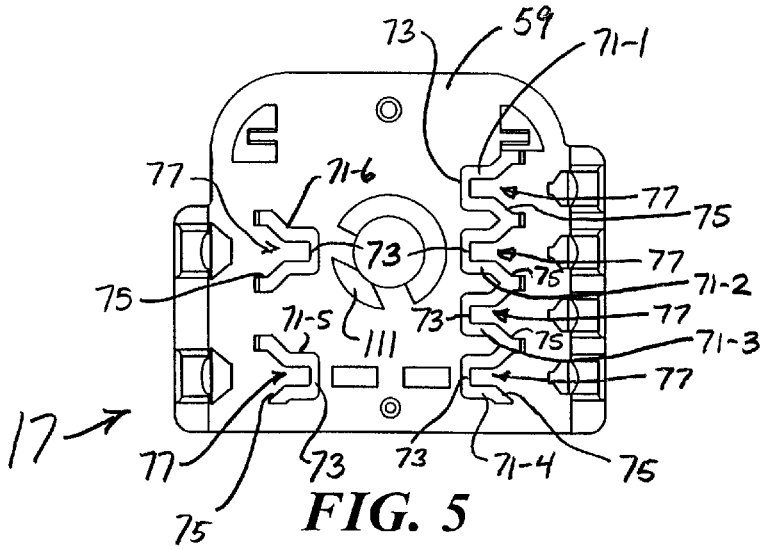
FIG. 5 is a plan view of the inner surface of the cover shown in FIG. 1.

As shown most clearly in FIG. 5, a plurality of guide walls 71 are formed onto bottom surface 59 of cover 17. As can be appreciated, the particular construction of guide walls 71 serves as a novel feature of the present invention and as a principal distinction from U.S. Pat. No. 5,072,078 to C.P. Rao et al., which is hereby incorporated by reference.

A first guide wall 71-1, a second guide wall 71-2, a third guide wall 71-3 and a fourth guide wall 714 are integrally formed onto bottom surface 59 in a vertical column. In addition, a fifth guide wall 71-5 and a sixth guide wall 71-6 are integrally formed onto bottom surface 59 in a spaced apart relation with sixth guide wall 71-6 disposed directly above fifth guide wall 71-5.

It should be noted that first guide wall 71-1, second guide wall 71-2, third guide wall 71-3 and fourth guide wall 714 are shown as being integrally formed together, end-to-end, to form a single continuous wall. However, it is to be understood that first guide wall 71-1, second guide wall 71-2, third guide wall 71-3 and fourth guide wall 71-4 need not be formed together as a single, continuous wall. Rather, first guide wall 71-1, second guide wall 71-2, third guide wall 71-3 and fourth guide wall 71-4 could be separate from one another and formed onto bottom surface 59 in a spaced apart, vertical column without departing from the spirit of the present invention.

Each guide wall 71 is inwardly tapered to form a funnel-type configuration. Specifically, each guide wall 71 includes a narrowly-spaced closed end 73 and a widely-spaced open end 75. As such, each guide wall 71 is shaped to define a slot 77 for receiving the bare end of an associated conductive wire.

It should be noted that the inward taper of slot 77 serves to properly direct the bare end of an associated conductive wire inserted therethrough into closed end 73. Furthermore, the inward taper of slot 77 serves to ensure that the associated conductive wire inserted into switch 11 is disposed in its proper orientation and position, which is a principal object of the present invention. Specifically, the inward taper of slot 77 serves to properly position the bared end of the associated conductive wire into the V-shaped groove 32 of upwardly-bent end portion 31, thereby optimizing the connection between the wire and its associated terminal and maximizing the retentive force of the wire within switch 11, which is highly desirable.

It should further be noted that the width of slot 77 at narrowly-spaced closed end 73 is only slightly wider than the width of an individual conductive wire. As such, with an individual conductive wire disposed into the corresponding slot 77 of a guide wall 71, the free end of the conductive wire is fittingly disposed within closed end 73, as seen most clearly in FIG. 6. As a result, closed end 73 serves to limit the bending, twisting or any other undesirable movement of the wire within switch 11, which is a principal object of the present invention. As can be appreciated, limiting the movement of the conductive wire within switch 11 is highly desirable. Specifically, limiting the movement of the conductive wire within switch 11 serves to reduce the leverage action, or crowbar effect, of the wire to inwardly bend the end portion 31 of its associated terminal in such as manner so as to decrease the retentive force of the conductive wire within the switch.

Accordingly, guide wall 71-1 is adapted to receive bared end 49 of ribbon cable 47 in its proper position to ensure adequate contact between bared end 49 and output terminal 25-1. Guide wall 71-2 is adapted to receive bared end 51 of ribbon cable 47 in its proper position to ensure adequate contact between bared end 51 and output terminal 25-2. Guide wall 71-3 is adapted to receive bared end 53 of ribbon cable 47 in its proper position to ensure adequate contact between bared end 53 and output terminal 25-3. Guide wall 71-4 is adapted to receive bared end 55 of ribbon cable 47 in its proper position to ensure adequate contact between bared end 55 and splice terminal 27. Guide wall 71-5 is adapted to receive bared end 45 of neutral lead 43 in its proper position to ensure adequate contact between bared end 45 and splice terminal 27. Guide wall 71-6 is adapted to receive bared end 41 of input lead 37 to ensure adequate contact between bared end 41 and input terminal 29.

As can be appreciated, since all the bared ends of the conductive wires are disposed in closed proximity to one another within switch 11, it is critical that these bared ends remain segregated to prevent short circuiting. Accordingly, each guide wall 71 serves to receive and electrically isolate an associated bared end, which is a principal object of the present invention.

Actuation Shaft, Movable Contact and Detent Spring

Rotary switch 11 also comprises an actuation shaft 79, a movable contact 81 and a spring finger 83.

Actuation shaft 79 is rotatably disposed within housing 13 and comprises an integral indexing cam 85 having an undulating outer edge. A centrally positioned pin extends integrally from indexing cam 85 so that when cover 17 is secured onto base 13, the free end of pin is received in a hub 87 integrally formed in base 13 so as to create an end bearing for actuating shaft 79. Actuating shaft 79 also comprises a free end 89 which is preferably constructed to receive any suitable knob or handle (not shown) for facilitating rotation of actuation shaft 79.

Movable contact 81 is secured onto indexing cam 85 of actuation shaft 79 by any suitable means, such as by means of pins 91 extending integrally from indexing cam 85 through openings in movable contact 81, the ends of pins 91 being offset to hold movable contact 81 securely on indexing cam 85. Movable contact 81 comprises three contact fingers 93, 95 and 97, and a fourth oppositely disposed contact finger 99.

Detent spring 83 is generally V-shaped and comprises a pair of ends 101 and an apex 103. Integrally molded abutments 105 are provided on inner surface 59, each abutment 105 defining a slot. 105 therein which is sized and shaped to receive an end 101 of detent spring 83. Apex 103 of detent spring 83 is sized and shaped to resiliently engage the undulating outer periphery of indexing cam 85.

Although actuating shaft 79 is not actually fixedly secured to cover 17, detent spring 83, which is in resilient engagement with indexing cam 85, functions to retain actuating shaft 79 onto cover 17. As such, if an operator is required to remove cover 17 from base 15, there are no loose parts that will drop from switch 11, thereby facilitating and expediting the assembly procedure, which is highly desirable.

Accordingly, with switch 11 properly assembled, contact finger 99 will selectively engage one of output terminals 25, depending upon the rotary position of actuating shaft 79, so as to effect the low, medium or high speed for the fan motor of the electric appliance. At the same time, one of contact fingers 93, 95 or 97 will be in electrical contact with input terminal 29 to complete the circuit through switch 11. Actuation shaft 79 is additionally rotatable to a fourth position wherein contact finger 99 is not in electrical contact with any of output terminals 25, thereby providing switch 11 with its "off" position.

It should be noted that, in order to limit rotary movement of actuation shaft 79, an arcuate abutment 109 is integrally formed onto actuation shaft 79 adjacent indexing cam 85. Arcuate abutment 109 is sized and shaped to rotate within with an arcuate groove, or recess, 111 provided in bottom surface 59 of cover 17.

The embodiment of the present invention described above is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A rotary switch for receiving a plurality of conductive wires, each of said plurality of conductive wires having a free end, said rotary switch comprising:

(a) a housing sized and shaped to receive the plurality of conductive wires, said housing comprising,
(i) a base, and
(ii) a cover mounted on said base, said cover comprising a top surface, a bottom surface, and a first inwardly tapered guide wall formed onto and protruding out from the bottom surface, the first inwardly tapered guide wall being shaped to define a slot which is sized and shaped to receive one of said plurality of conductive wires, (b) a plurality of conductive terminals fixedly mounted onto said housing, each conductive terminal being sized and shaped to electrically connect with an associated conductive wire, (c) an actuation shaft rotatably mounted onto said housing, and (d) a movable contact mounted onto said actuation shaft, wherein said movable contact selectively connects selected conductive terminals.

2. The rotary switch as claimed in claim 1 wherein the first inwardly tapered guide wall is sized and shaped to electrically isolate the one of said plurality of conductive wires from the others of said plurality of conductive wires.

3. The rotary switch as claimed in claim 2 wherein the first inwardly tapered guide wall is sized and shaped to limit the movement of the free end of the one of said plurality of conductive wires disposed therewithin.

4. The rotary switch as claimed in claim 3 wherein the first inwardly tapered guide wall has a funnel-type configuration.

5. The rotary switch as claimed in claim 4 wherein the first inwardly tapered guide wall includes a closed end and an open end.

6. The rotary switch as claimed in claim 5 wherein the slot defined by the first inwardly tapered guide wall is narrower at the closed end than at the open end.

7. The rotary switch as claimed in claim 6 wherein the width of the slot at the closed end of the first inwardly tapered guide wall is slightly larger than the width of the one of said plurality of conductive wires.

8. The rotary switch as claimed in claim 7 further comprising a second inwardly tapered guide wall.

9. A housing for a rotary switch, said housing being sized and shaped to receive a plurality of conductive wires, each of said plurality of conductive wires having a free end, said housing comprising:

(a) a base, and (b) a cover mounted onto said base, said cover comprising a top surface, a bottom surface and at least one inwardly tapered guide wall formed on and protruding out from the bottom surface, the at least one inwardly tapered guide wall being shaped to define a slot which is sized and shaped to receive one of said plurality of conductive wires.

10. The housing as claimed in claim 9 wherein the at least one inwardly tapered guide wall is sized and shaped to electrically isolate the one of said plurality of conductive wires from the others of said plurality of conductive wires and to limit the movement of the free end of the one of said plurality of conductive wires disposed therewithin.

11. The housing as claimed in claim 10 wherein the at least one inwardly tapered guide wall has a funnel-type configuration and includes a closed end and an open end.

12. The housing as claimed in claim 11 wherein the slot defined by the at least one inwardly tapered guide wall is narrower at the closed end than at the open end, the width of the slot at the closed end being slightly larger than the width of the one of the plurality of conductive wires.

13. A cover for a rotary switch sized and shaped to receive a plurality of conductive wires, each of said plurality of conductive wires having a free end, said cover comprising:

(a) a top surface, (b) a bottom surface, and (c) at least one inwardly tapered guide wall formed on and protruding out from the bottom surface, the at least one inwardly tapered guide wall being shaped to define a slot which is sized and shaped to receive one of said plurality of conductive wires.

14. The cover as claimed in claim 13 wherein the at least one inwardly tapered guide wall is sized and shaped to electrically isolate the one of said plurality of conductive wires from the others of said plurality of conductive wires and to limit the movement of the free end of the one of said plurality of conductive wires disposed therewithin.

15. The cover as claimed in claim 14 wherein the at least one inwardly tapered guide wall has a funnel-type configuration and includes a closed end and an open end.

16. The cover as claimed in claim 15 wherein the slot defined by the at least one inwardly tapered guide wall is narrower at the closed end than at the open end, the width of the slot at the closed end being slightly larger than the width of the one of the plurality of conductive wires.

17. A rotary switch for receiving a plurality of conductive wires, each of said plurality of conductive wires having a free end, said rotary switch comprising:

(a) a housing sized and shaped to receive the plurality of conductive wires, said housing comprising,
(i) a base, and
(ii) a cover mounted on said base, said cover comprising,
(A) a top surface,
(B) a bottom surface,
(C) a first inwardly tapered guide wall, the first inwardly tapered guide wall being formed onto the bottom surface and shaped to define a slot which is sized and shaped to receive one of said plurality of conductive wires, the first inwardly tapered guide wall being sized and shaped to electrically isolate the one of said plurality of conductive wires from the others of said plurality of conductive wires and to limit the movement of the free end of the one of said plurality of conductive wires disposed therewithin, wherein the first inwardly tapered guide wall has a funnel-type configuration and is shaped to include a closed end and an open end, the slot defined by the first inwardly tapered guide wall being narrower at the closed end than at the open end, the width of the slot at the closed end of the first inwardly tapered guide wall being slightly larger than the width of the one of said plurality of conductive wires, and
(D) a second inwardly tapered guide wall connected to the first inwardly tapered guide wall, (b) a plurality of conductive terminals fixedly mounted onto said housing, each conductive terminal being sized and shaped to electrically connect with an associated conductive wire, (c) an actuation shaft rotatably mounted onto said housing, and (d) a movable contact mounted onto said actuation shaft, wherein said movable contact selectively connects selected conductive terminals.

* * * * *